US012447386B1

(12) United States Patent
Cowan-Bondick et al.

(10) Patent No.: US 12,447,386 B1
(45) Date of Patent: Oct. 21, 2025

(54) TENNIS NET COVER

(71) Applicants: Gisela Cowan-Bondick, Concord, MA (US); Timo Joerg Siebert, Sudbury, MA (US)

(72) Inventors: Gisela Cowan-Bondick, Concord, MA (US); Timo Joerg Siebert, Sudbury, MA (US)

(73) Assignees: Gisela Cowan-Bondick, Concord, MA (US); Timo Joerg Siebert, Sudbury, MA (US)

( * ) Notice: Subject to any disclaimer, the term of this patent is extended or adjusted under 35 U.S.C. 154(b) by 0 days.

(21) Appl. No.: 16/928,348

(22) Filed: Jul. 14, 2020

(51) Int. Cl.
*A63B 61/00* (2006.01)
*A63B 69/38* (2006.01)

(52) U.S. Cl.
CPC ..... *A63B 61/003* (2013.01); *A63B 69/38* (2013.01); *A63B 2209/10* (2013.01)

(58) Field of Classification Search
CPC ..... A63B 69/00; A63B 61/003
See application file for complete search history.

(56) References Cited

U.S. PATENT DOCUMENTS

| | | | | |
|---|---|---|---|---|
| 9,545,551 | B1 | 1/2017 | Dinoffer | |
| 2004/0127308 | A1* | 7/2004 | Swanson | A63B 69/0002 473/454 |
| 2007/0265115 | A1* | 11/2007 | Farquhar | A63B 63/004 473/446 |
| 2012/0316010 | A1* | 12/2012 | Prince | A63B 63/00 473/422 |
| 2017/0102117 | A1* | 4/2017 | Cordova | A63C 19/00 |

OTHER PUBLICATIONS

"Net ZoneTM Instructions", 2016, 3 pages, retrieved from https://oncourtoffcourt.com/content/netzone-introduction.pdf.
"How to hit Fewer Balls in the Net", Net Zone, 2020, 5 pages, screenshots from videos available at https://oncourtoffcourt.com/netzone/.
"Tennis Teaching Net—Netzone Net Cover—Mansion Select", 2011, 2 pages, screenshots from videos available at https://www.youtube.com/watch?v=O7_FhqwvWFk.

* cited by examiner

*Primary Examiner* — Eugene L Kim
*Assistant Examiner* — Christopher Glenn
(74) *Attorney, Agent, or Firm* — ArentFox Schiff LLP

(57) ABSTRACT

An example apparatus includes a covering that is opaque and straps to attach the covering to a tennis net. The straps are configured to attach the covering below a top tape of the tennis net. The apparatus is weighted so that, after attachment to the tennis net, a height of the tennis net is unchanged.

23 Claims, 6 Drawing Sheets

TENNIS NET COVER

TECHNICAL FIELD

This specification relates generally to example tennis net covers.

BACKGROUND

Tennis is a sport that is played on a court that is divided by a tennis net ("net"). Each player uses a racquet to hit a ball over the net to the other player. The other player hits the ball back. This continues until one player hits a winning shot that cannot be returned by the opponent, a player misses the ball, or a player makes an unforced error such as hitting the ball out of bounds or hitting the ball into the net, in which case the player loses the point. The player who exceeds a predefined point threshold wins the game.

SUMMARY

An example apparatus includes a net covering that is opaque and straps to attach the covering to a tennis net. The straps are configured to attach the covering so that it is below a top tape of the tennis net. The apparatus is weighted so that, after attachment to the tennis net, a height of the tennis net is unchanged. The apparatus may include one or more of the following features, either alone or in combination.

The entirety of the apparatus may have a weight of five pounds (2.27 kilograms) or less, four pounds (1.82 kilograms) or less, three pounds (1.36 kilograms) or less, or two pounds (0.91 kilograms) or less. The straps may be colored to match a color of the top tape of the tennis net. The covering may be colored to match a coloring of the tennis net. The straps each may include a fabric strip having hooks that that are temporarily connectable to a fabric strip that is on the covering and that includes loops to connect to the hooks. The covering may include one or more strips to which the straps connect. The straps and the one or more strips may include hook and loop tape.

The covering may be configured to cover only a portion of the tennis net between singles lines on a tennis court. The covering may include nylon, cotton, a synthetic fabric, or a combination thereof. The straps may be arranged around a perimeter of the covering and along a center strip on the covering.

An example system includes a tennis net that is attachable to a tennis court between posts. The tennis net has a top tape that is designed for visibility against the tennis court. The system also includes a net cover that attaches to the tennis net between the posts. The net cover includes a covering that is opaque and that is configured to attach to the tennis net so that the top tape remains visible when the net cover is attached. The net cover is weighted so that, after attachment to the tennis net, a height of the tennis net is unchanged. The system may include one or more of the following features, either alone or in combination.

The net cover may include straps to attach the covering to the tennis net. The straps are configured to attach the covering to the tennis net so that the covering is below the top tape. The net cover may include one or more strips to which the straps connect. The one or more strips and the straps may be or include hook and loop tape that is detachable. An example is VELCRO® brand fastener. The net cover may have a weight of five pounds (2.27 kilograms) or less, four pounds (1.82 kilograms) or less, three pounds (1.36 kilograms) or less, or two pounds (0.91 kilograms) or less.

The straps may be colored to match a color of the top tape of the tennis net. The covering may be colored to match a coloring of the tennis net. The covering may include at least one of cotton, nylon, synthetic fabric, or a composite material containing one or more of cotton, nylon, or synthetic fabric.

Any two or more of the features described in this specification, including in this summary section, can be combined to form implementations not specifically described herein.

The details of one or more implementations are set forth in the accompanying drawings and the description below. Other features, objects, and advantages will be apparent from the description and drawings, and from the claims.

DESCRIPTION OF THE DRAWINGS

Like reference numerals in different figures indicate like elements.

DETAILED DESCRIPTION

Described herein are examples of net covers that attach to a tennis net ("net"). In this regard, a typical net is connectable between two posts across a tennis court ("court"). The net is comprised of a mesh that extends between the two posts and a top tape that extends along a length of the net between the posts. The International Tennis Federation (ITF) requires that, for official play, the top tape must be colored white to stand-out against the darker color of the court. The white may also match lines that delineate the doubles or singles parts of the tennis court. An example net cover includes a covering that is opaque and that is configured to attach to one side of the net so that the top tape remains visible. The covering is weighted so that, following attachment to the net, a height of the net remains unchanged. The covering thus blocks part of the view from each opposing side of the court, without affecting net height and while keeping the top tape visible to both players. Accordingly, rather than relying on sight to aim the ball to the opposing side of the court, each player is instead conditioned to aim the ball by relying on the feel of impact between the ball and the racquet. For example, a player may be conditioned to hit the ball with sufficient top spin so that the ball clears the net but still falls in-bounds on the opposing side of the court.

Figure 1:
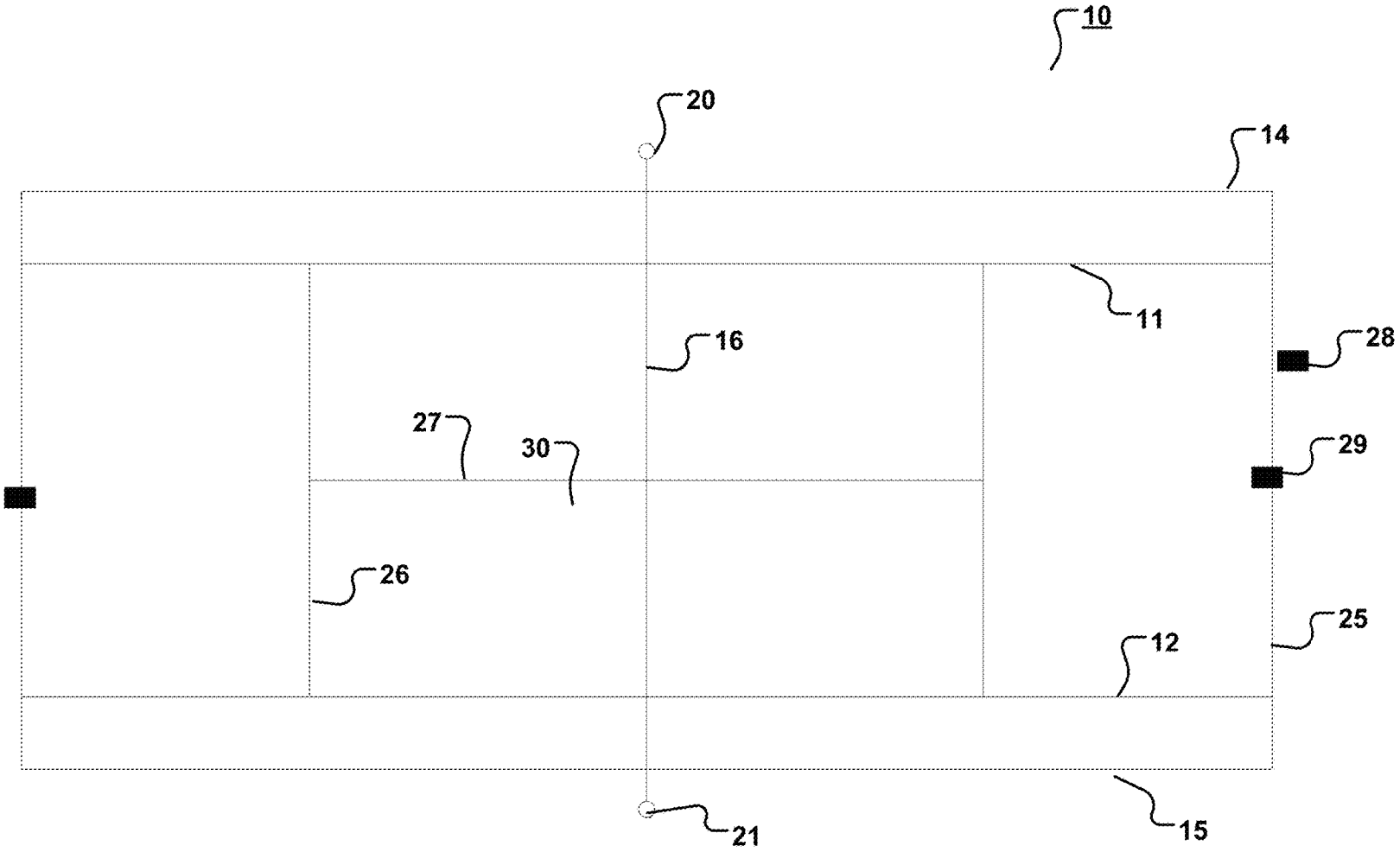
FIG. 1 is a top view of a tennis court.
Figure 2:
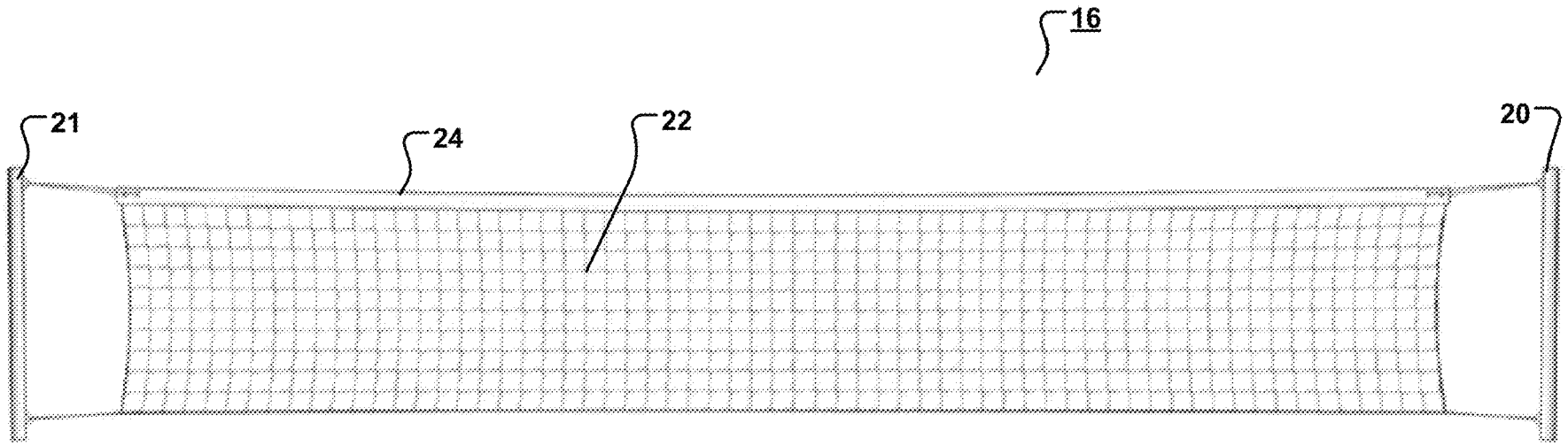
FIG. 2 is a front view of a tennis net

FIG. 1 is a top view showing an example of a tennis court 10. Tennis court 10 is partitioned for singles play and for doubles play. In singles play, a single player is on each opposing side of the court. In doubles play, two players are on each opposing side of the court. The singles play portion of court 10 is between the singles sidelines 11, 12 and the doubles play portion of court 10 is between the double sidelines 14, 15. A net 16 connected to posts 20, 21 on each side of the court divides the court into two equal opposing sides. The net may be made of a black mesh material. The net also includes a white tape across its top that extends along the length of the mesh. FIG. 2 shows a front view of an example of net 16 having mesh 22 and top tape 24. The top tape is white in this case and the top tape is between two inches (5.08 centimeters (cm)) and 2.5 inches (6.35 cm) in height.

The lines drawn on court 10 may be drawn in white to contrast the darker background color of the court, which may be green, blue, or black in some cases. The lines on both sides of the court are the same; accordingly, only one line on each side may be described. The lines include baseline 25, service line 26, singles sidelines 11, 12, doubles sidelines 14, 15, and center service line 27. The baseline defines the point from which a player serves a ball to the opposing side of the court. The ball is served from one side of the center mark 29 to the diagonally-opposite side of the court. So, for example, a player—the server—may serve the ball from point 28 to the right of center mark 29 and into the diagonally-opposite service box 30 defined by service line 26, net 16, and center service line 27. If the served ball does not fall within that box 30, then the ball is deemed out-of-bounds. The server then has another opportunity to serve the ball. If the server again fails to hit the ball within service box 30, the other player receives a point. If the server hits the ball within service box 30, the other player may hit the ball back to the server. This may continue until one of the players hits a winning shot that the opponent fails to return or one of the players hits the ball out of bounds or into the net, thereby committing either a forced or an unforced error. A forced error is caused by an opponent's good play, whereas an unforced error occurs when a player makes a mistake. The judging of these is partly subjective. In the case of singles play, the ball is out-of-bounds if it lands outside of singles sidelines 11, 12 or beyond a baseline such as baseline 25. In the case of doubles play, the ball is out-of-bounds if lands outside of doubles sidelines 14, 15 or beyond a baseline such as baseline 25. An unforced error may occur when a player hits the ball into the net or out-of-bounds.

Oftentimes, during a game, players strive to impart top-spin when hitting the ball. To produce top-spin on a tennis stroke, a player starts the stroke below the ball and brushes up on the ball at the same time as the player hits through the ball. This is further achieved with an accentuated upwards flick of the wrist to increase the upwards brush on the ball. This combined down-to-up upwards brushing of the ball during the stroke exerts a torque about the center of the ball and causes the ball to rotate with a forward spin during its flight. In other words, the ball rotates in the direction of travel of the ball. Another way to describe producing top-spin is as follows. To hit a ball to produce top-spin, a player rotates a head of their racquet over the top of the ball when the ball is hit. The racquet moves from the bottom of the ball to the top of the ball. The rotation applied by the racquet exerts a torque about a center of the ball. This torque causes the ball to rotate with a forward spin during its flight. As explained above, this causes the ball to rotate in the direction of travel of the ball.

Figure 3:
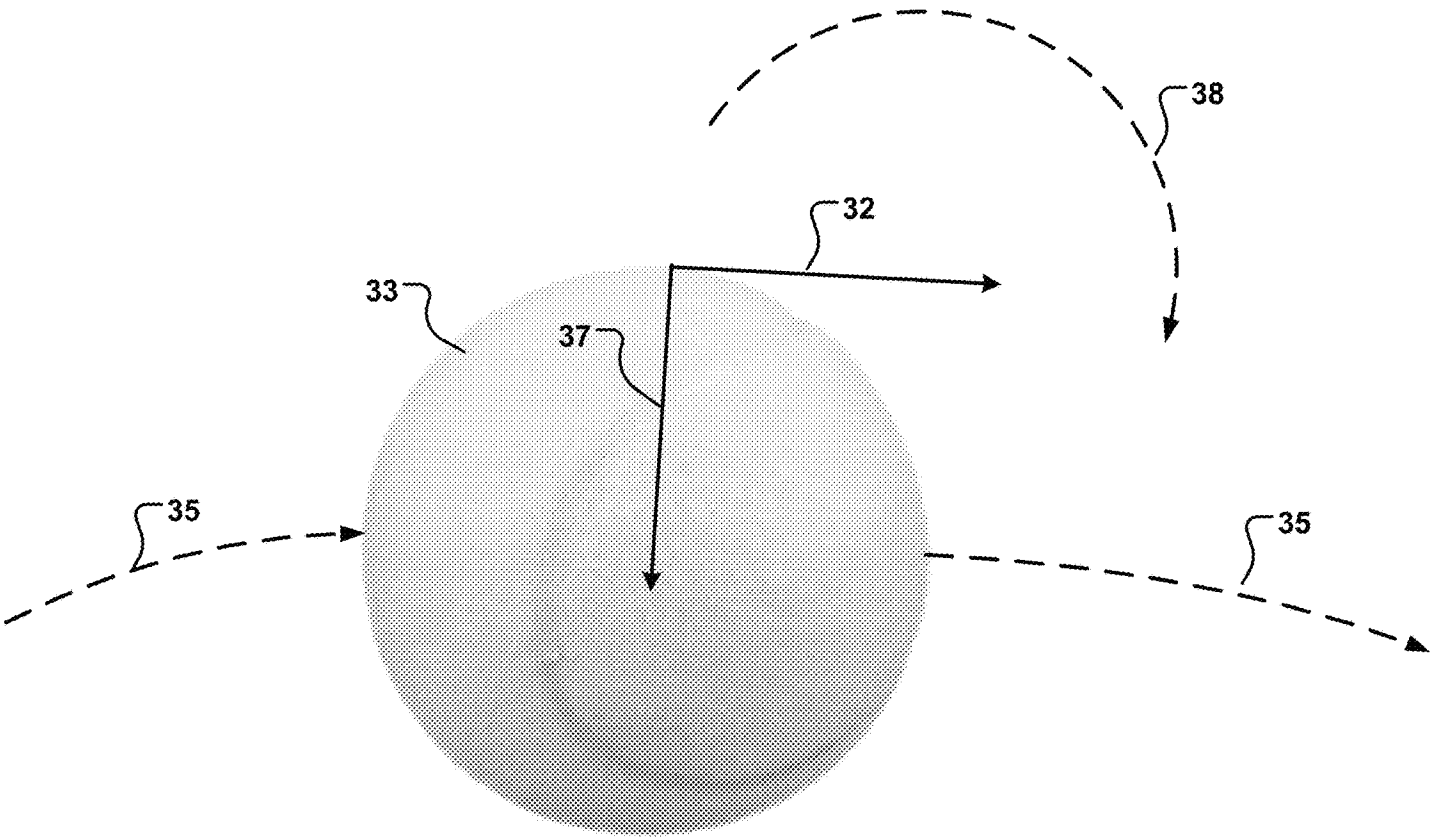
FIG. 3 is a side view of a tennis ball in flight.

Referring to FIG. 3, when top-spin is applied, a tangential velocity 32 of a top of ball 33 points in the same general direction as a trajectory 35 of the ball. The ball spins in the direction of arrow 38, which is a forward spin in the direction of travel. Hitting a ball to produce top-spin causes a Magnus force to act on the ball. The Magnus force 37 is perpendicular to the velocity of the ball in the downward direction. Due to this additional downward force on the ball caused by applying top-spin to the ball, the ball can be hit with a greater speed and greater force and still land inside the baseline of the opposing side of the court. Furthermore, because the additional downward force pulls the ball downwards, the ball can be hit higher above the net, which reduces unforced errors into the net and may also make the ball more difficult to return by increasing the depth of where the ball lands on the opposing court. This phenomenon also typically results in a higher bounce for the ball, which also makes the ball more difficult to return because it causes the ball to be above a player's typical strike zone.

The example net covers described herein are configured to block all or part of each player's view of the opposing side of the court, while preserving their view of the top tape. By blocking the view of the opposing side of the court, the net cover conditions a tennis player to learn which racquet motions apply top-spin to a ball without the player relying on visual cues such as the lines on the opposing side of the court. For example, rather than aiming the ball based on the lines on the opposing side of the court, the player learns, through feel and trial and error, the optimal or preferred amount of top-spin that will result in a ball flight path that is higher above the net (to reduce or to minimize unforced errors into the net) but that still causes the ball to land deep on the opposing side of the court and remain inside the opposing baseline.

Figure 4:
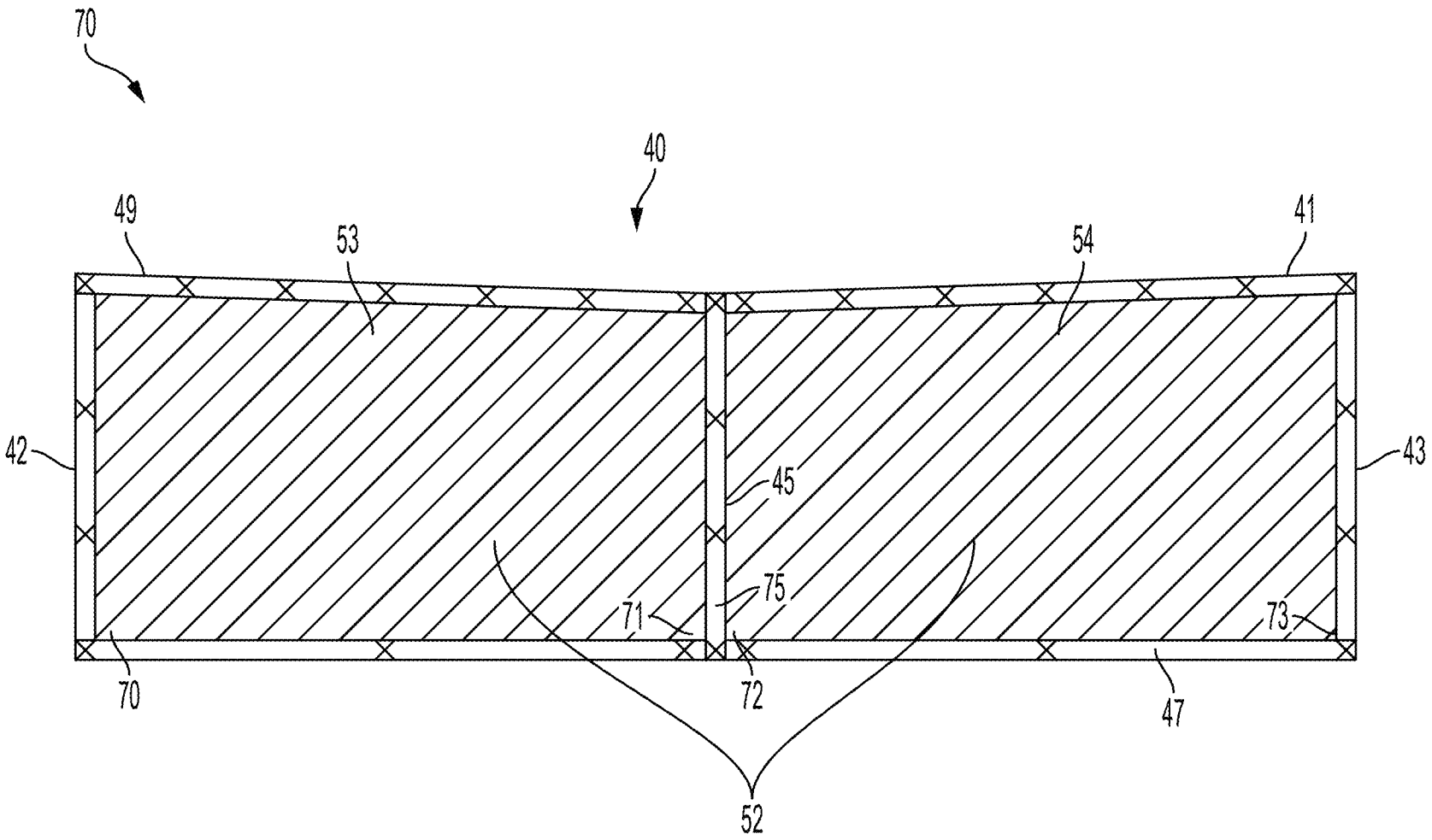
FIG. 4 is a front view of an example tennis net cover.

In the example of FIG. 4, net cover 40 includes a covering that is made from an opaque material that blocks each player's view of the opposing side of the court. The net cover attaches to the net, as described below. The covering may be same color as the mesh of the net. For example, both may be black. By making the covering the same color as the mesh, the net cover need only attach to one side of the net. For example, the covering may include a single panel of fabric that attaches to face only one half of the court. Because the covering is the same color as the net, the player that is opposite to the side where the net cover is attached will not be distracted by the mesh sticking-out against the net. As a result, the net cover may be equally effective for players on both opposing sides of the court. Furthermore, because the net cover need only be attached to a single side of the net, the weight of the net cover can be reduced relative to net covers that are applied to both sides of the net. This may be important because weight applied to the net may reduce the height of the net—for example, the weight may drag-down the net. Reducing the height of the net is undesirable because changes in net height affect the amount of top-spin needed for the ball to clear the net and, therefore, affect how the player will be conditioned to hit the ball during play. In some implementations, the height of the net is not affected by the net cover, which will cause the player to develop a stroke that can be used during play after the net cover is removed from the net.

The net cover attaches to the net so that the top tape of the net remains visible to players on both opposing sides of the court during play. Maintaining visibility of the top tape has been found to be beneficial to training. In this regard, the top tape defines the top of the net. Allowing the player a clear view of the top of the net allows the player to calibrate their stroke so that the ball clears the net. For example, the player can use the net height to gauge, at least partly, the proper amount of top-spin to apply to the ball. Covering the top tape can make it more difficult for a player to identify the top of the net and, therefore, may make it more difficult to train the player to apply the correct amount of top-spin. Covering the top tape also makes the play less realistic. In some implementations, however, the top tape may be covered if desired.

As shown in FIG. 4, net cover 40 includes attached straps (labeled "x" in FIG. 4 and referred to herein simply as as "straps") that are arranged around the perimeter 41, 42, 47, 43 of the net cover and, in some examples, down its center 75 to connect the net cover to one side of the tennis net. The straps may be mounted to a flat nylon webbing 49 that is attached around the perimeter of covering 52 and down its center. This nylon webbing is described below. The straps are configured to connect the net cover so that the covering 52 that blocks the net is below the top tape of the net. In the example of FIG. 4, there are thirteen straps along the top 41 of the net cover, with one in the middle of the net cover. In the example of FIG. 4, there are four straps down each side 42, 43 of the net cover and four straps down the middle 45 of the net cover. In the example of FIG. 4, there are five straps along the bottom 47 of the net cover, with one in the middle of the net cover. The total number of straps in the example of FIG. 4 is 24. The number of straps is greater at the top than at the bottom to ensure that the mesh of the net remains covered at the top even during wind and that there is no sagging of the top edge of the net cover, ensuring it remains against the top tape. Draping of the net cover fabric will achieve the same effect at the bottom of the net cover at least in part, hence the need for fewer straps there. In some implementations, the number of straps may be different and the configuration and placement of straps may be different. In some implementations, a weighted cording material (not shown) may be added at or near (for example, within one inch (2.54 cm), two inches (5.08 cm) or three inches (7.62 cm) the bottom 47 of the net cover and may span the length of the net cover to provide enhanced stability. For example, the weighted cording may provide added weight in some cases. The weighted cording may be used in conjunction with nylon webbing 49 that is around the perimeter and center of the covering and that frames the net cover.

Figure 6:
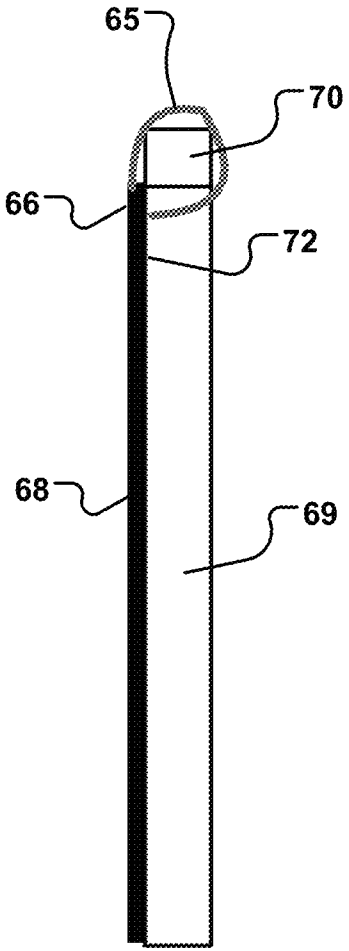
FIG. 6 is a side view of the tennis net cover attached to a tennis net.

In some examples, the straps may each be or include a fabric strip having hooks that that are temporarily connectable to loops on a counterpart fabric strip on the covering (or vice versa). For example, referring to FIG. 6, a strap 65 on one side of a nylon webbing 66 of a net cover 68 may loop through the mesh of the net or (as shown in this example) over the top of top tape 70 and connect back through the mesh 69 to mate to a counterpart fabric strip on the other side 72 of the nylon webbing or covering. In some implementations, there may be separate counterpart fabric strips for each fabric strip on the fastener or there may be a one or more counterpart fabric strips that are attachable to multiple straps. In some cases, the straps may connect to the net cover using hook and loop tape. In some implementations, the straps may connect to the net cover using VELCRO® brand fasteners. Other connections between the net and net cover may be used, such as snaps or buttons. In some implementations, the attachment straps are sewn into nylon webbing 49. In some implementations, this nylon webbing 49 may measure three inches (7.62 cm) wide, two inches (5.08 cm) wide, or one inch (2.54 cm) wide, and may run the length of the net cover along top 41 and bottom 47 and may run the height of the net cover on its sides 42, 43 and in its center 45.

In some implementations, the straps connect to and through the net mesh adjacent to the top tape. In these examples, the straps may be the same color as the mesh (for example, black) so as not to stand out against the mesh. In some implementations, the straps connect over the top tape and may be a same color as the top tape (for example, white) so as not to distract the players from the top tape.

Connecting the net cover down the center of the net as shown in FIG. 4 reduces the chances that the net cover will move during play. For example, wind, rain, or other disturbances may cause the net cover to move relative to the net. This can be distracting to the players and may, in some cases, cause the net to be uncovered. The connection down the center of the net reduces the chances of these occurring. In some implementations, however, the connection down the center of the net may be omitted.

Figure 5:
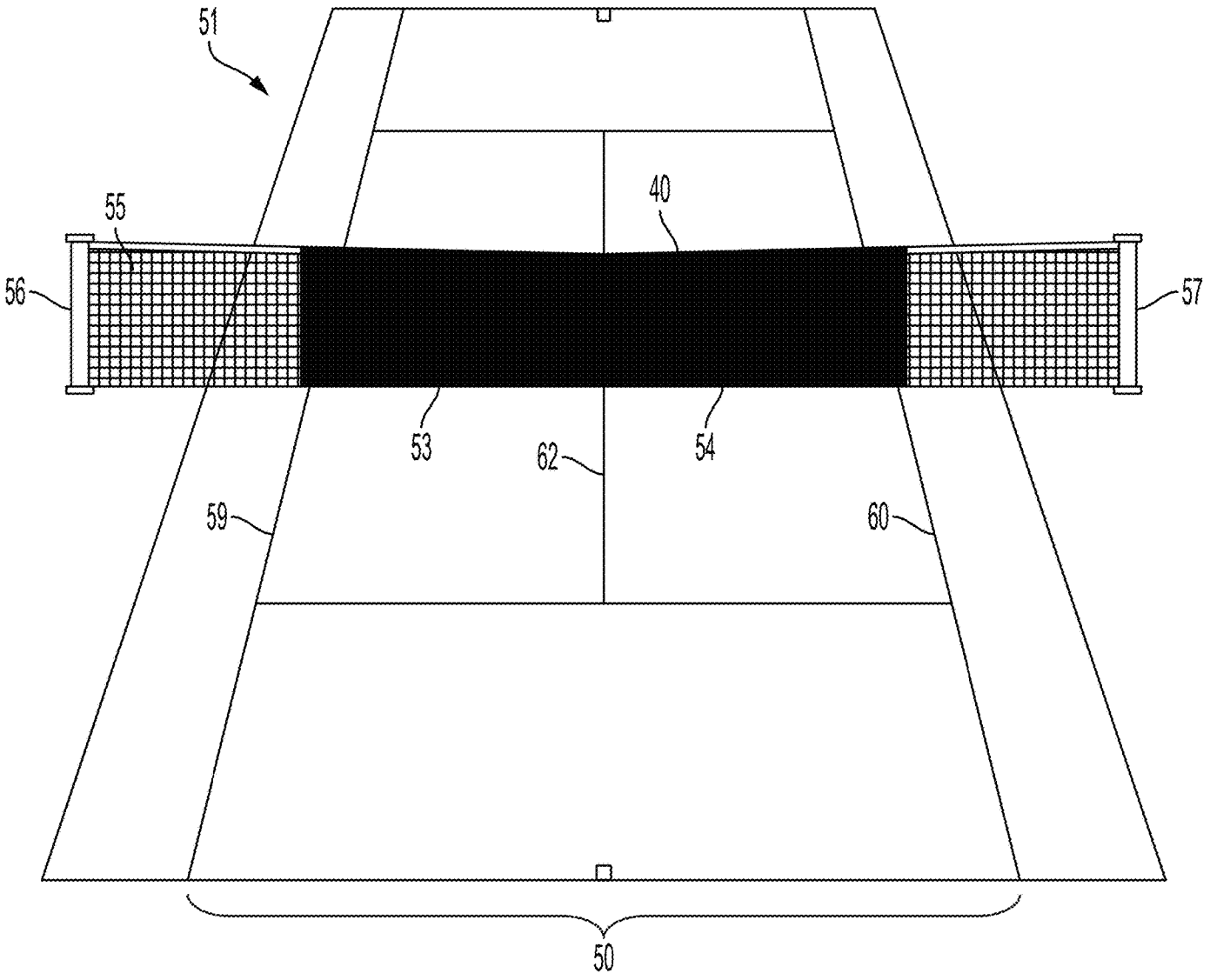
FIG. 5 is a front perspective view of the tennis net cover installed on a tennis net.

FIG. 5 shows example net cover 40 used to block only the singles play portion 50 of the court 51. In this example, the center of the net cover includes a length of flat nylon webbing (labeled 75 in FIG. 4) that extends from a top of the net cover to the bottom of the net cover. In some implementations, the nylon webbing may be absent or not included. The nylon webbing may be about 2 inches (5 cm) wide in some implementations. The nylon webbing may be the point of connection between the net cover and the center of the net.

The center nylon webbing also separates the net cover into left and right halves 53, 54 as also shown in FIG. 4. Each of these halves is not strictly rectangular in shape because the net itself, when hung, is not strictly rectangular in shape. Rather, in FIG. 5, the net 55 is 42 inches (106.7 cm) high at each pole 56, 57, 40 inches (101.6 cm) high at each singles sideline 59, 60, and 36 inches (91.4 cm) high at the centerline 62 of the net. Accordingly, as shown in FIG. 4, each half 53 and 54 of the net cover is shaped as a right-angled trapezoid having two adjacent right angles 70, 71 and 72, 73, respectively. Furthermore, in this example each half of the net cover is a mirror image of the other half and the two halves connect to each other at the center nylon webbing 75. In the example where the net cover blocks the singles play portion of the court only (shown in FIG. 5), the net cover has a height of 36 inches (91.4 cm) at its center, a height of 40 inches (101.6 cm) at its opposite sides 42 and 43, and a length of 27 feet (8.23 meters). In an example where the net cover blocks the doubles play portion of the court (not shown), the net cover has a height of 36 inches (91.4 cm) at its center, a height of 42 inches (106.7 cm) at its opposite sides 42 and 43, and a length of 36 feet (10.97 meters). By matching the size and shape of the net cover fairly precisely to the size and shape of the net, the amount of excess fabric in the net cover is reduced. Reductions in excess fabric may reduce the size and weight of the net cover and also may reduce interference and distractions during play that can be caused by excess fabric on the court and/or moving in the wind.

As explained previously, the net cover is attachable to the net to block all or part of the net without changing a height of the net at all or, in some cases, without changing the height of the net by more than an acceptable amount, such as by one centimeter or less, by half a centimeter or less, by four millimeters or less, by three millimeters or less, by two millimeters or less, or by one millimeter or less. As explained above, significant changes to the height of the net are undesirable because those changes affect how the players learn to hit the ball. Accordingly, the net cover described herein may be made of a lightweight material that may be water-resistant. Water resistances prevents or reduces weight gain due to water absorption. The material may also generate little or no noise during movement in order to reduce distractions during play. For example, the net cover may be made out or include a synthetic fabric, nylon, treated cotton, a composite containing a synthetic fabric, nylon and/or cotton, or any other appropriate material. When particularly lightweight fabrics are used for example, the net cover may include two panels that attach to both sides of the net—that is, one panel faces each opposing side of the court. Stretchable material may distort the shape of the net in some cases.

If the net cover is configured to connect to the posts, some stretchable material may be used at the connection between the net cover and the posts.

In some implementations, the entire net cover may have a weight of five pounds (2.27 kilograms) or less, four pounds (1.82 kilograms) or less, or two pounds (0.91 kilograms) or less. Other weights are also possible, particularly those that do not affect the height of the net when the net cover is attached to the net. The net cover is configured—for example, constructed, sized, and/or shaped—to fold to about 15 inches (38 cm) in height or less by 12 inches (30 cm) in width or less by 7.5 inches (19 cm) in depth or less. Other volumes, whether smaller or larger, may be achieved.

In some implementations, the net cover may extend only across the singles play portion 50 of the court as shown in FIG. 5, and does not extend into the doubles play portion of the court. In some implementations, the net cover may extend across the singles play portion 50 of the court and extend only part-way into the doubles play portion of the court. In these implementations, the net cover may be used to train singles players primarily. In some implementations, the net cover may extend across the entirety of the net, covering both the singes play and doubles play portions of the net. The increase in size and weight required to cover the doubles play portion of the net may militate against using a doubles play sized net cover for singles play.

The net cover is described herein in the context of a tennis net. However, the net cover may be installed on nets used for other racquet-based or non-racquet-based sports.

Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. An apparatus comprising:

a covering that is opaque, the covering comprising two halves, with each half and of the covering being shaped as a right-angled trapezoid having adjacent right angles; and straps to attach the covering to a tennis net, the straps being configured to attach the covering below a top tape of the tennis net, the straps comprising straps vertically-arranged in a line along a middle between two vertical sides of the covering, the straps to attach the middle of the covering to the tennis net;

wherein the apparatus is weighted so that, after attachment to the tennis net, a height of the tennis net is unchanged.

2. The apparatus of claim 1, wherein the apparatus has a weight of five pounds (2.27 kilograms) or less.

3. The apparatus of claim 1, wherein the apparatus has a weight of four pounds (1.82 kilograms) or less.

4. The apparatus of claim 1, wherein the apparatus has a weight of two pounds (0.91 kilograms) or less.

5. The apparatus of claim 1, wherein the straps comprise straps that are configured to attach the covering to a top tape of the tennis net and that are colored to match a color of the top tape of the tennis net.

6. The apparatus of claim 1, wherein the covering is colored to match a coloring of the tennis net.

7. The apparatus of claim 1, wherein the straps each comprise a fabric strip having hooks that are temporarily connectable to a fabric strip on the covering having loops.

8. The apparatus of claim 1, wherein the covering comprises one or more strips to which the straps connect, the straps and the one or more strips comprising hook and loop tape.

9. The apparatus of claim 1, wherein the covering is configured to cover only a portion of the tennis net between singles lines on a tennis court.

10. The apparatus of claim 1, wherein the covering comprises nylon.

11. The apparatus of claim 1, wherein the covering comprises cotton.

12. The apparatus of claim 1, wherein the covering comprises synthetic fabric.

13. The apparatus of claim 1, wherein some of the straps are arranged around a perimeter of the covering.

14. A system comprising:

a tennis net that is attachable to a tennis court between posts, the tennis net having a top tape that is designed for visibility against the tennis court; and a net cover that attaches to the tennis net between the posts, the net cover comprising:

a covering that is opaque and that is configured to attach to the tennis net so that the top tape remains visible, the covering extending across at least an entire singles-play portion of the tennis net, the covering comprising two halves, with each half and of the covering being shaped as a right-angled trapezoid having adjacent right angles;

straps to attach the covering to the tennis net, the straps being configured to attach the covering to the top tape so that the covering is below the top tape, the straps having a same color as the top tape;

wherein the net cover is weighted so that, after attachment to the tennis net, a height of the tennis net is unchanged.

15. The system of claim 14, wherein the net cover comprises one or more strips to which the straps connect, the one or more strips and the straps comprising hook and loop tape that is detachable.

16. The system of claim 14, wherein the net cover has a weight of five pounds (2.27 kilograms) or less.

17. The system of claim 14, wherein the covering is colored to match a coloring of the tennis net.

18. The system of claim 14, wherein the covering comprises at least one of cotton, nylon, synthetic fabric, or a composite material containing one or more of cotton, nylon, or synthetic fabric.

19. The system of claim 14, wherein the covering extends across a doubles-play portion of the tennis net.

20. The system of claim 14, wherein the net cover has a weight of five pounds (2.27 kilograms) or less.

21. The system of claim 14, wherein the net cover has a weight of four pounds (1.82 kilograms) or less.

22. The system of claim 14, wherein the net cover has a weight of two pounds (0.91 kilograms) or less.

23. The system of claim 14, wherein some of the straps are arranged around a perimeter of the covering.

* * * * *